United States Patent [19]

Claypool et al.

[11] 4,040,195

[45] Aug. 9, 1977

[54] PAGE TURNER APPARATUS

[75] Inventors: James P. Claypool, Minneapolis; Gerrit Hoogenraad, Minnesota Lake, both of Minn.

[73] Assignee: Donald C. Delich, Minneapolis, Minn. ; a part interest

[21] Appl. No.: 677,279

[22] Filed: Apr. 15, 1976

[51] Int. Cl.[2] ..... B41J 11/38

[52] U.S. Cl. ..... 40/341; 40/342; 84/487; 84/517

[58] Field of Search ..... 40/341, 342, 343; 84/486–518

[56] References Cited

U.S. PATENT DOCUMENTS

| | | | |
|---|---|---|---|
| 1,605,258 | 11/1926 | Meiszner | 84/508 |
| 1,735,166 | 11/1929 | Hossell et al. | 84/486 |
| 3,064,518 | 11/1962 | Chernishenko | 84/487 |
| 3,823,638 | 7/1974 | Bombardi | 84/511 X |

*Primary Examiner*—Ernest T. Wright, Jr.
*Assistant Examiner*—A. Heinz
*Attorney, Agent, or Firm*—Dugger, Johnson & Westman

[57] ABSTRACT

Page turner apparatus that includes a book support having a transverse ledge and a top flange, a slide plate on the support for transverse movement, the slide plate having a plurality of parallel slots for the pages to be turned extended therethrough, and operable mechanism for mounting the slide plate and selectively moving the slide plate to turn a page. The operable mechanism of each of the first and third embodiments includes a toothed rack slidably mounted on a slide rod and attached to the slide plate, and a foot pedal operated cable for selectively moving the rack in a page turning direction. In the second embodiment the operable mechanism includes a motor for driving a rod having a threaded portion cooperating with the threaded portion of a slide plate mounting block for transversely moving said block.

13 Claims, 7 Drawing Figures

FIG. 4
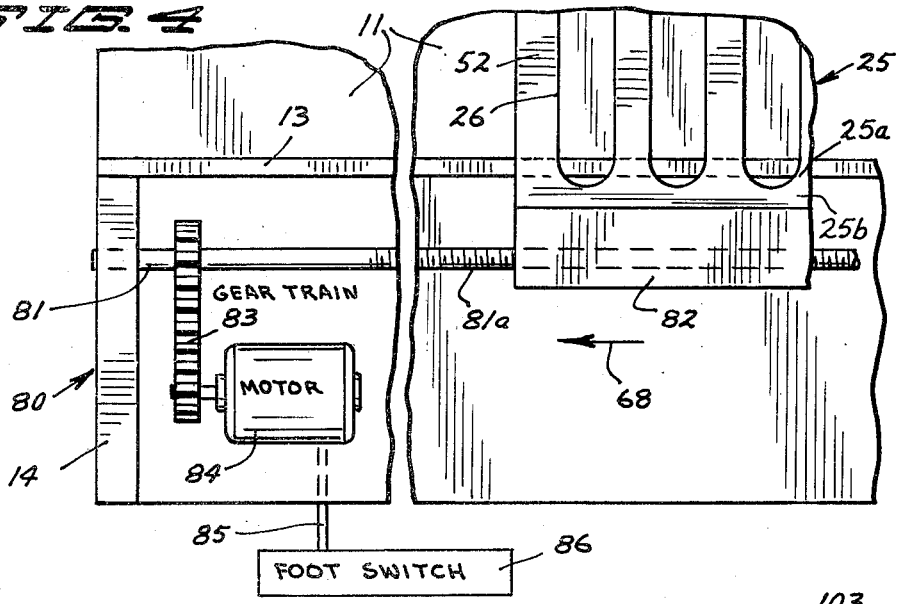
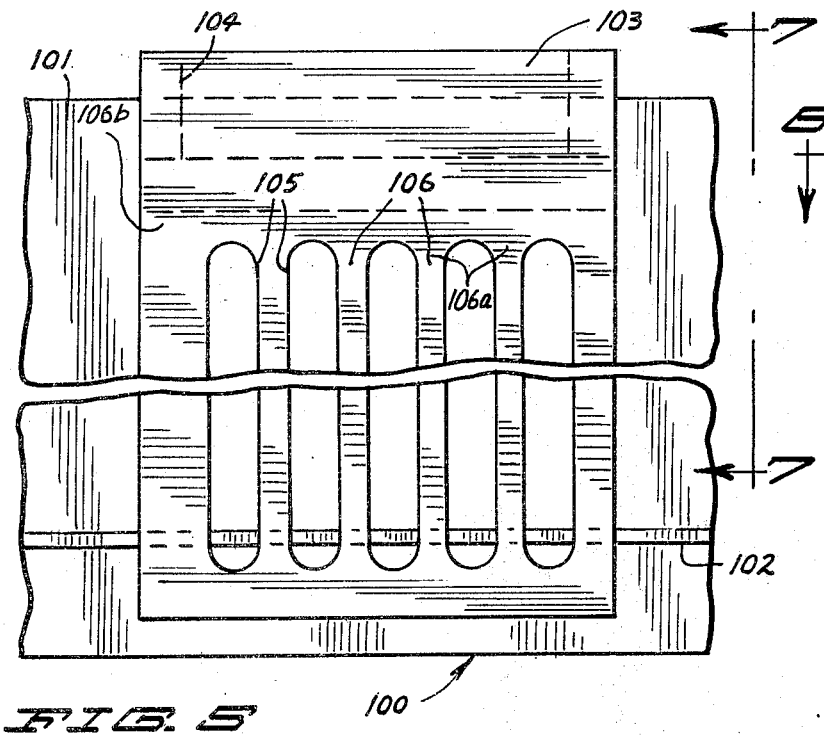
FIG. 5
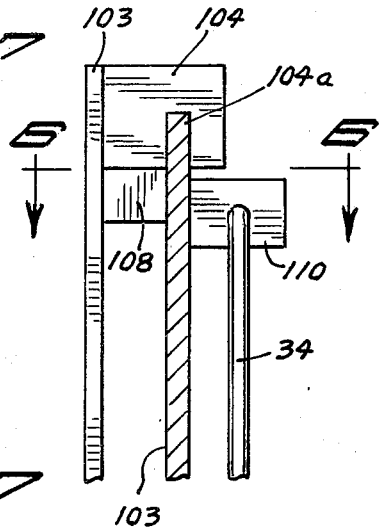
FIG. 7
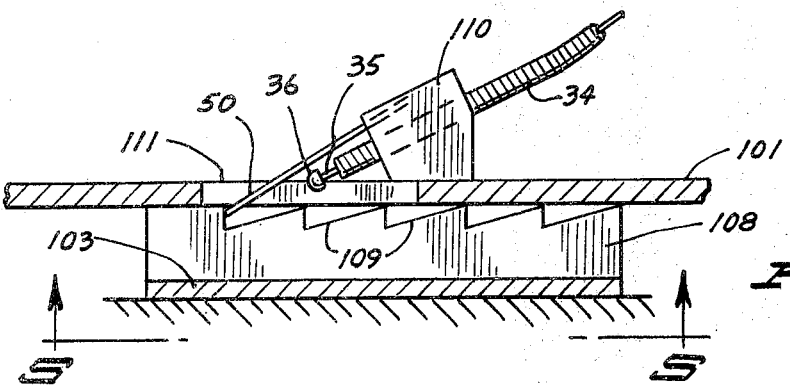
FIG. 6

PAGE TURNER APPARATUS

BACKGROUND OF THE INVENTION

Apparatus for turning pages of a book.

In prior art page turners that have page turner portions interleaved between the pages, for example, see U.S. Pat. Nos. 1,217,840; 1,735,166 and 3,064,518, there are provided a relatively large number of parts that are movable individually relative one another. The provision of a relatively large number of parts results in a page being of a more complex construction than desired. In other prior art page turners it is possible for a pad that engages a page to be turned to slip relative at least a portion of a page to be turned and as a result not function properly. In order to overcome problems such as the above, as well as others, this invention has been made.

SUMMARY OF THE INVENTION

Page turner apparatus that includes a support for supporting a book in an open condition, a slide member having a plurality of bar portions extendable between pages to be turned, and operable mechanism for mounting the slide member and transversely translating the slide member to turn pages of the book.

One of the objects of this invention is to provide new and novel mechanism for pages of a book, and in particular for turning pages of sheet music during the course of playing music. Another object of this invention is to provide new and novel mechanism for turning pages of a book that is operable by other than the hands of the user, to, for example, leave the hands of a player free to play music. A further object of this invention is to provide new and novel means that is partially extendable between a plurality of book pages for successively turning one page after another as it is translated in one direction. An additional object of this invention is to provide a new and novel page turner that is of a relatively simple construction and has only a few moving parts.

BRIEF DESCRIPTION OF THE DRAWINGS

FIG. 4 is a fragmentary plan view of the second embodiment of this invention, a portion being diagrammatically shown;

FIG. 5 is a fragmentary plan view of the third embodiment of this invention that is generally taken along the line and in the direction of the arrows 5—5 of FIG. 6;

FIG. 6 is a fragmentary transverse cross-sectional view generally taken along the line and in the direction of the arrows 6—6 of FIG. 7; and FIG. 7 is a fragmentary view that is generally taken along the line and in the direction of the arrows 7—7 of FIG. 5.

Referring now to FIGS. 1-3, the first embodiment of the apparatus of this invention, generally designated 10, includes a base or support 11 which may be a flat plate for supporting a book or the like in an open condition. Advantageously, the support 11 is mounted on a stand (not shown) or other suitable structure for holding the support at an angle relative the horizontal that is convenient for the user. A top transverse flange 12 is joined to the upper edge of the support to extend outwardly from the front surface of the support while a transversely elongated ledge 13 is joined to the support to extend outwardly therefrom at a location adjacent the bottom of the support but spaced therefrom.

Figures 1, 2, 3:
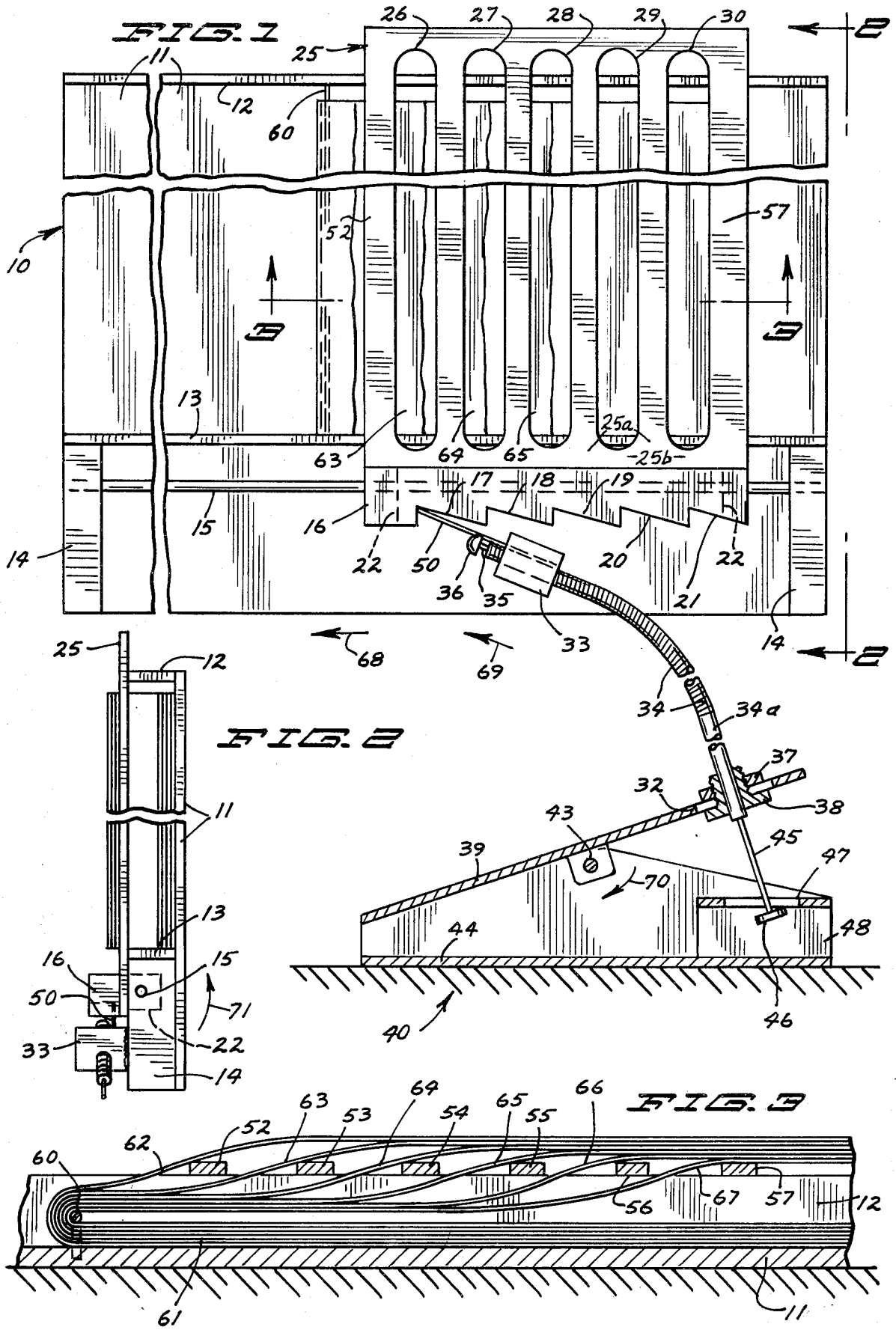
FIG. 1 shows a portion of the apparatus of the first embodiment of the invention in plan, and the foot pedal switch in vertical cross section, portions of the apparatus being broken away.
FIG. 2 is a fragmentary end view generally taken along the line and in the direction of the arrows 2—2 of FIG. 1.
FIG. 3 is a fragmentary transverse cross-sectional view generally taken along the line and in the direction of the arrows 3—3 of FIG. 1 to more fully illustrate the relationship of the pages to the slide member prior to the movement of the slide member for turning the first page.

Transversely spaced blocks 14 are mounted on the support below the ledge, the blocks mounting a transversely elongated slide rod 15. The opposite ends of a transversely elongated rack 16 mount blocks 22, the blocks 22 being slidably mounted on the slide rod 15. The rack has a plurality of teeth, teeth 17-21 being illustrated. The lower edge portion of a slide plate, generally designated 25 and preferably of clear or transparent plastic, is mounted by the rack such that the slide plate extends away from the rack in a direction opposite the opening of the rack teeth. The under surface of the slide plate bears against the edges of the ledge and the flange 12 that are remote from the front surface of the support whereby the slide plate extends substantially parallel to the front surface of the support. The slide plate has a plurality of vertically elongated slots, slots 26-30 being illustrated. The vertical length of each of the slots is substantially greater than the length of the pages of the book to be read. Additionally, the slots are of a length to extend closely adjacent the ledge 13. The slots provide finger or bar portions 52-57 with the bar portion 52 being between the slot 26 and the left hand edge of the slide plate as illustrated in FIG. 1, and bar portion 57 being provided between slot 30 and the right hand edge of the slide plate. Each of the finger portions has a first end portion **25*a* fixedly joined to slide plate portion 25*b*. It is to be understood that if the page turner apparatus is to be used for turning more than six pages such as per the embodiment illustrated in FIGS. 1-3**, then additional slots and rack teeth would be provided.

For operating the rack to move in the direction of the arrow 68 there is provided a foot pedal switch, generally designated 40. The switch includes a foot operated plate 39 that has an intermediate portion pivotally connected at 43 to a frame 44. One end of the plate includes an elongated slot 32 through which the rigid sheath end portion **34*a* of a cable 34 is extended. The enlarged diameter flange of a member 38 that is attached to the sheath end portion of the cable abuts against the under surface of the plate 39 and a nut 37 is threaded on member 38 to abut against the opposite surface of the plate to permit limited slidable movement of the rigid sheath end portion of the cable relative the plate and at the same time precludes the sheath end portion moving away from the plate. The opposite end portion of the cable sheath extends through a mounting block 33 which is mounted on the support 11 below the rack. Slidably extended through the sheath 34*a* is a cable wire 35, the one end portion of the wire that extends outwardly of the said opposite end portion of the cable sheath mounting a resilient foot 36. The opposite end portion of the wire is attached to a plunger 45, the plunger extending through a slot 47 in a mount 48. The mount 48 is mounted on the base portion of the frame 44. The head end portion 46 of the plunger is located between the web of the mount and the base of the frame to permit limited movement of the plunger in a vertical direction and along the length of the slot while retaining the head end portion of the plunger between the mount web and the frame base. The plunger 45 is slidably extended into the rigid cable sheath end portion and as the plate 39 is pivoted in the direction of the arrow 70, the foot 36 is moved toward the rack. A stop wire 50 is mounted by the block 33 to abut against the adjacent rack tooth surface that extends perpendicular to the slide rod to prevent the rack moving in the direction of the arrow opposite 68 when the foot 36** is being retracted with reference to the rack.

In using the apparatus of the first embodiment invention, at least the pages of the book to be turned are slid between the web of a bail 60 that is attached to the support and the top surface of the support to a position that the binding of the book is closely adjacent the bail. Now, with the slide plate in the position illustrated in FIG. 1 (right hand side of the support), advantageously the slide plate is pivoted about the slide rod 15 in the direction of the arrow 71 a limited amount so as to be spaced from the top flange 12. This facilitates positioning the pages to be turned relative the slide plate for extending other than the first page to be turned through the slide plate slots. With reference thereto, it is to be mentioned that the slide plate slots are of lengths sufficiently greater than the length of the pages to permit extending the pages through the slots even when the slide plate is pivoted. That is, page 67 is positioned so that it underlies bar portions 52–56 from the binding to slot 30 and then is extended through slot 30 to overlap bar portion 57; the next to last page to be turned, page 66, underlies bar portions 52–55 and is extended through slot 29 to overlie bar portions 56, 57, etc, with the first page 62 to be turned extending from the binding and in overlying relationship to bar portions 52–57. Thereafter, the slide plate is pivoted back to abut against flange 12 and the pages 62–67 to be turned are positioned relative the slide plate such as shown in FIG. 3 while the rack is located such as illustrated in FIG. 1. Now upon the pivoting the foot plate in the direction of the arrow 70, the cable wire 35 is moved to move foot 36 in the direction of the arrow 69 to bring foot 36 into abutting engagement with the edge that extends perpendicular to the slide rod 15 that is to the left of tooth 17 as seen in FIG. 1. Further movement of the foot 36 in the direction of the arrow 69 results in the rack and the structure connected thereto being transversely moved in the direction of the arrow 68 for a distance sufficiently great that bar portion 52 is moved from the right side of bail 60 to be located on the left of bail 60 and thereabove while the edge of bar portion 53 that in part defines slot 27 is still located to the right of bail 60. As a result, only page 62 is turned. As the rack is moved in the direction of arrow 68, the end of the stop 50 remote from mount 33 slides over the inclined surface of tooth 17 and then resiliently snaps to a position to be closely adjacent or abut against the surface of tooth 17 that extends perpendicular to the slide rod.

Upon moving the foot plate in the direction opposite arrow 70, if the foot 36 bears against the inclined tooth surface of tooth 17 to tend to retract it (move rack in the direction opposite arrow 68), the aforementioned perpendicular edge of tooth 17 abuts against stop 50 whereby the rack is precluded from moving in the direction opposite arrow 68 as the foot is retracted. Now, upon again pivoting plate 39 in the direction of the arrow 70, the foot 36 moves into abutting engagement with the surface of tooth 18 that extends perpendicular to the slide rod to move the rack in the direction of the arrow, the stop wires 50 being pushed out of the way of the rack by inclined surface of the tooth 18 and thence snapping back to abut against the edge of tooth 18 that extends perpendicular to the slide rod upon the slide plate being moved to a position that page 63 is turned.

After all the pages have been positioned relative the slide plate to be turned have been turned, the end of the stop wire 50 remote from block 33 may be manually forced outwardly from the rack to permit the rack being slid back to the position of FIG. 1, and the rack may be pivoted to a position facilitating the extension of the next group of pages to be turned through the slots as previously described.

Referring now to FIG. 4, the second embodiment of the invention, generally designated 80, includes a support 11, a top flange (not shown), a ledge 13, a slide plate 25, and blocks 14 that are of the same construction as described with reference to the first embodiment. However, instead of the blocks 14 mounting the slide rod, said blocks rotatably mount an elongated rod 81 having a threaded portion 81*a*. The threaded portion 81*a* extends through a portion of a rack or slide plate mounting member 82 that has threads that cooperate with rod portion 81*a* for transversely moving the slide plate as the rod 81 is rotated. With reference thereto when the rod is rotated in a direction for moving the block in the direction of arrow 68, the slide plate is urged to pivot in a direction to abut against ledge 13 rather than in the opposite direction. The slide plate mount 82 is attached to the end portion of the slide plate 25 that is adjacent ledge 13.

For rotating the rod 81, a motor 84 is mounted on the support and through a suitable gear train 83, is drivingly connected to the rod 81. A foot switch 86 is connected to suitable control mechanism 85 for operating the motor. The control mechanism may be of a nature that the motor continues to operate until the foot switch is operated to an off position, or through suitable conventional control mechanism such as indicated in U.S. Pat. No. 2,755,580 may deenergize the motor upon the motor turning the rod sufficiently that one page is turned. If such control mechanism is provided, then it would be necessary to operate the switch 86 to an "on" position and subsequently back to an "off" position before operating the switch again to an "on" for turning another page. Since the operator of the second embodiment is the same as for the first embodiment other than the mechanism for moving the slide plate mount or rack, the use thereof will not be further set forth.

Referring now to FIGS. 5–7, the third embodiment of this invention, generally designated 100, includes a book support 101 having a ledge 102 extending outwardly of the front surface of the support. The upper edge portion of the support is extended into the slots 104*a* of generally U-shaped, transversely spaced slide blocks 104 whereby the slide blocks may be slid along the top edge of the support. Blocks 104 are joined to the under surface of the upper edge portion of the slide plate 103 whereby when support 101 is extended into the slots 104*a*, said block and the ledge 102 supporting the slide plate in generally parallel relationship to the front surface of the support. A rack 108 is joined to the under surface of the upper edge portion of the slide plate at a location adjacent the slide blocks to be located between the top edge of the support and the ledge 102. The rack 108 is of the same construction as rack 16; however, rack 108 is mounted such that the teeth open to the under surface of the support.

The slide plate includes a plurality of elongated slots 105 that define bar portions 106 such as described with reference to slots 26–30 and bar portions 52–57 of the first embodiment. Each of the bar portions (finger portions) 106 has a first end portion 106*a* fixedly joined to slide plate portion 106*b*.

For operating the rack 108, there is provided foot pedal mechanism 40 of the same construction described with reference to the first embodiment. However, the end portion of the cable remote from the foot pedal is mounted by a cable mounting block 110 that is attached to the back surface of the support 101. The support has an elongated slot 111 that opens to the rack whereby stop wire 50 extends through slot 111 to abut against the rack teeth, and the foot 36 is movable through the slot 111 for engaging the rack teeth to move the rack 108 in a manner described with reference to the rack 16.

Even though the apparatus of this invention is particularly usable by musicians wherein they would require an hour or more to play 6–10 pages of music, it is to be understood that the apparatus can also be used for physically incapacitated persons suffering paralysis or incapacities. In such a case, in place of a foot switch, an appropriate switch that can be operated by other portions of the body that are subject to voluntary movement can be utilized in place of the switch described herein. Additionally, it is to be understood that the slide plate may be provided with a greater number of slots than that illustrated whereby the page turner may be used for turning a greater number of pages; the limit on the number of pages that can be turned depending upon the width of the pages. Additionally, it is to be understood that it is not essential that the slide plate be provided with the upper portion joining the bar portions 52–57 as illustrated in FIG. 1 or a lower portion of FIG. 5.

As an example of one embodiment of the invention, but not as a limitation thereon, the transverse width of each of the slots, and each of the bar portions may be approximately one/half inch; and the height of the ledge approximately one/half inch. With such an embodiment, the spacing of adjacent surfaces of the teeth that extend perpendicular to the slide rod would be twice the width of the slot.

What is claimed is:

1. Page turner apparatus comprising a base for supporting a book in an open condition, a slide member for engaging and successively turning pages in the book; first means for mounting the slide member for translating movement on the base the slide member including a plurality of longitudinally extending, generally parallel finger portions for having a page extended between each adjacent pair of finger portions; said finger portions having first end portions; and second means joined to said first end portions of said finger portions for retaining the finger portions generally parallel and to simultaneously translate all of the finger portions as the slide member is moved to turn a page.

2. The apparatus of claim 1 further characterized in that the second means is fixedly joined to the first end portions.

3. The apparatus of claim 2 further characterized in that the first means includes a transversely elongated rod rotatably mounted on the base and having a transversely elongated threaded portion, a mounting block mounted on said rod and having threads threadingly engaging the rod to transversely move the block as the rod is rotated relative thereto, said block mounting the slide member to move it therewith, operable motor means drivingly connected to the rod, and switch means for selectively operating the motor means.

4. The apparatus of claim 2 further characterized in that said slide member comprises a generally flat, transparent plastic plate having slotted cutouts to define said finger portions and said second means.

5. The apparatus of claim 2 further characterized in that said first means comprises a transversely elongated rack mounted on said second means for transversely moving the slide member, a transversely elongated slide rod mounted on the base for slidably mounting the rack and operable means for selectively moving the rack transversely in one direction a distance to turn a page.

6. The apparatus of claim 5 further characterized in that the rack has a plurality of adjacent teeth that includes more than one tooth and that the operable means includes means for successively engaging one tooth after the other to translate the rack to turn pages.

7. The apparatus of claim 6 further characterized in that the last mentioned means includes a foot for abuttingly engaging a tooth, and means for generally reciprocally moving the foot between a retracted position and a second position spaced from the retracted position by a distance the foot moves the rack whereby the rack moves the slide member to turn one page as the foot is moved from its retracted position to its second position, and that there is provided stop means for resiliently engaging a rack tooth to block movement of the rack in a direction opposite said one direction as the foot is moved from its second position to its retracted position.

8. The apparatus of claim 6 further characterized in that the last mentioned means includes a cable having a cable sheath that has a first end portion and means for attaching the sheath first end portion to the base on the same side thereof as the slide member.

9. The apparatus of claim 6 further characterized in that the last mentioned means includes a cable having a cable sheath that has a first end portion, a wire slidably extended in that sheath and having a first end portion and a foot mounted on the wire first end portion, and a cable mount for attaching the cable sheath first end portion to the base on the side opposite the slide plate, said base having a slot for the foot to extend through to engage the rack teeth.

10. The apparatus of claim 6 further characterized in that the slide member comprises a transparent, flat plastic plate having longitudinally elongated cutouts defining said finger portions and the second means; said teeth being linearly aligned and each tooth being of a transverse dimension that is substantially the same as the corresponding dimension of one finger plus one cutout.

11. Page turner apparatus comprising a base for supporting a book in an open condition, several parallel longitudinally elongated finger portions for having a page extended between each adjacent pair of finger portions, first means fixedly joined to the finger portions to retain the finger portions in general parallel relationship, and second means for mounting the first means on the base and for transversely moving the first means to simultaneously move the finger portions to turn a page, the second means comprising third means for mounting the first means and moving the first means therewith, a transversely elongated rod mounting the third means for transverse movement and fourth means for mounting the rod on the base.

12. The apparatus of claim 11 further characterized in that the fourth means mounts the rod for rotation, that the rod has a threaded portion, that the third means includes means mounted on the threaded portion for moving the first means transversely as the rod is rotated and that the second means includes operable means for selectively rotating the rod.

13. The apparatus of claim 11 further characterized in that the third means includes a transversely elongated rack having a plurality of teeth that includes more than one tooth, and that the second means includes operable means for engaging a rack tooth to selectively move the rack transversely relative the rod.

* * * * *